US005645687A

United States Patent [19]

Ambady et al.

[11] Patent Number: 5,645,687

[45] Date of Patent: Jul. 8, 1997

[54] PROCESS FOR MANUFACTURING BLEACHED PULP WITH REDUCED CHLORIDE PRODUCTION

[75] Inventors: Raman Ambady; Dale E. Nutter, Jr., both of Pensacola; Dewey W. Barnes, Defuniak Springs, all of Fla.

[73] Assignee: Champion International Corporation, Stamford, Conn.

[21] Appl. No.: 499,871

[22] Filed: Jul. 10, 1995

[51] Int. Cl.[6] ..... D21C 9/153

[52] U.S. Cl. ..... 162/65; 162/89

[58] Field of Search ..... 162/18, 89, 65 B, 162/65

[56] References Cited

U.S. PATENT DOCUMENTS

| | | | |
|---|---|---|---|
| 4,959,124 | 9/1990 | Tsai | 162/65 |
| 5,133,946 | 7/1992 | Schwarzl | 422/186.12 |
| 5,164,043 | 11/1992 | Griggs et al. | 162/57 |

*Primary Examiner*—Donald E. Czaja
*Assistant Examiner*—Steven B. Leavitt

[57] ABSTRACT

A process for bleaching wood pulp is provided comprising subjecting the wood pulp, after brown stock washing, to an oxygen delignification stage, a washing sequence, a first chlorine dioxide or ozone bleaching stage, an oxidative extraction stage, an ozone activation stage followed by a chlorine dioxide bleaching stage in the absence of an intermediate washing stage.

25 Claims, 1 Drawing Sheet

PROCESS FOR MANUFACTURING BLEACHED PULP WITH REDUCED CHLORIDE PRODUCTION

FIELD OF THE INVENTION

This invention relates to an improved method for manufacturing bleached pulp. More particularly, this invention relates to improvements in processes for the manufacture of bleached pulp using chlorine based bleaching agents resulting in reduced chloride production and higher pulp brightness ceilings.

BACKGROUND OF THE INVENTION

In the conventional Kraft process, wood pulp is produced by digestion of wood chips in a pulping liquor usually containing sodium hydroxide and sodium sulfide as the active pulping chemicals. Following the wood digestion process, pulp is separated from the spent pulping liquor. The spent pulping liquor is then recovered and regenerated for recycling. The Kraft process wood pulp is then bleached and purified in a bleach plant operation. In the bleach plant, pulp is usually subjected to at least one bleaching stage under acidic conditions with a bleaching agent such as ozone, chlorine, chlorine dioxide, mixtures of chlorine and chlorine dioxide and the like, followed by at least one bleaching stage under alkaline conditions with a bleaching agent such as hydrogen peroxide, oxygen or a combination thereof. Depending on the desired pulp brightness, additional acidic or alkaline bleaching stages are employed. Following each bleaching stage, spent bleaching chemicals are usually removed from the pulp by washing with a suitable source of water; as for example fresh water or previously used water from pulp washing or a combination of the two.

SUMMARY OF THE INVENTION

One aspect of this invention relates to an improved process for manufacturing bleached wood pulp comprising subjecting brown stock washed wood pulp (preferably having a Kappa Number equal to or less than about 30 (preferably equal or less than about 25, more preferably equal to or less than about 20 and most preferably from about 5 to about 20)) after one or more brown stock washing stages to a bleach sequence comprising the steps of:

bleaching said washed pulp in a first acidic bleaching stage wherein the pH at some point during said bleaching stage is less than 7, (preferably equal to or less than about 6, more preferably equal to or less than about 5 and most preferably from about 1 to about 5) as for example, bleaching under acidic conditions with an active bleaching agent comprising ozone, elemental chlorine, hydrogen peroxide, chlorine dioxide, peracids such as peroxymono sulfuric acid (Caro's Acid), peroxyacetic acid, dimethyl dioxirane or mixtures thereof, preferably bleaching under acidic conditions with an active bleaching agent comprising not more than about 20% active elemental chlorine, more preferably not more than about 5% to about 10% active elemental chlorine and most preferably not more than about 5% active elemental chlorine, and in the embodiments of choice no or substantially no elemental chlorine (i.e. less than about 1% to about 5%) to form a first acidic bleached pulp;

bleaching said first acidic bleached pulp in a first alkaline bleaching stage wherein the pH at some point during said bleaching stage is greater than 7 (preferably equal to or greater than about 8.2, more preferably equal to or greater than about 9 and most preferably from about 9 to about 12) as for example bleaching under alkaline conditions with an active bleaching agent comprising hydrogen peroxide, oxygen, sodium hypochlorite or oxygen in the presence of base and peroxide, preferably an oxidative extraction with oxygen in the presence of base, more preferably such an extraction in the presence of an effective amount of hydrogen peroxide to form a first alkaline bleached pulp; and bleaching said first alkaline bleached pulp in a second acidic bleaching stage with an active bleaching agent comprising chlorine dioxide or a mixture of chlorine dioxide and elemental chlorine preferably chlorine dioxide which comprises not more than 20% active elemental chlorine, preferably not more than about 5 to about 10% active elemental chlorine and, most preferably not more than about 1 to about 5% active elemental chlorine to form a second acidic bleached pulp, said improvement comprising:

subjecting said first alkaline bleached pulp to an activation stage prior to bleaching said first alkaline bleached pulp in said second acidic bleaching stage, said activation stage comprising:

mixing said first alkaline bleached pulp after acidification with a gaseous mixture comprising an effective amount of ozone to form an activating mixture;

maintaining said activating mixture for a residence time and at a residence temperature sufficient to allow consumption of all or a portion of said ozone by one or more chemically reactive components of said pulp to form activated pulp; and subjecting said activated pulp to said second acidic bleaching stage in the absence of an intermediate washing stage to provide an activated second acidic bleached pulp having a brightness ceiling which is higher than the brightness ceiling of a second acidic bleached pulp bleached in a bleach sequence identical to that used to form the activated second acidic bleached pulp except for said activation stage.

As used herein, "brightness ceiling" is the brightness level of pulp bleached in a specific bleaching sequence which cannot be significantly increased (not more than 10%, preferably not more than about 5%, more preferably not more than 1% and most preferably not more than about 0.5% to about 0.1%) regardless of additional amounts of bleaching chemicals as measured using the procedure of TAPPI T452.

The process of the present invention provides for the bleaching of wood pulp in a manner that will allow for: 1) the production of pulp having acceptable quality, with a higher brightness ceiling and with lower consumption of bleach chemicals as compared to pulp formed using the base D(EOP)D D(EOP)(DD), D(EOP)(CD) or Z(EOP)D bleaching sequence; and 2) the reduction in build-up of chlorides in the bleach filtrates as compared to the base D(EOP)D, D(EOP)(DD), D(EOP)(CD) or Z(EOP)D bleaching sequence.

DETAILED DESCRIPTION OF THE INVENTION

Figure 1:
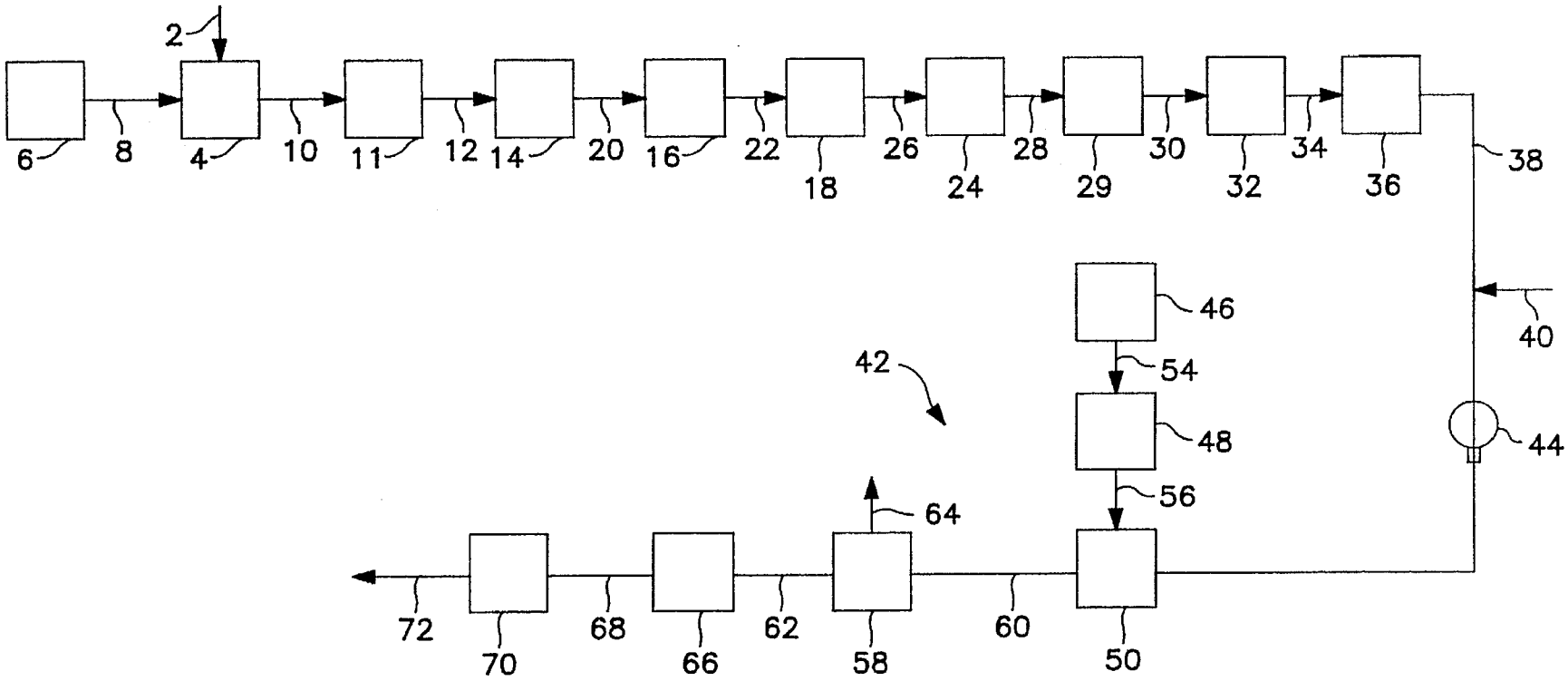
FIG. 1 is a schematic illustration of a preferred embodiment of the present invention.

The process of this invention is an improvement in those bleaching processes of the type comprising three bleaching stages, a first acidic bleaching stage, a first alkaline bleaching stage, and a second acidic bleaching stage with a bleaching agent comprising elemental chlorine, chlorine dioxide or a combination thereof. This process provides higher brightness ceilings for bleached pulp while at the same time providing reduced chloride concentrations in bleach plant filtrates thereby overcoming problems encountered in the recycle of such filtrates. Surprisingly, it has been discovered that treating the pulp in an activation stage after the extraction stage and prior to the second acidic bleaching stage in the absence of an intermediate washing stage substantially increases the brightness ceiling of the bleached pulp as compared to the brightness ceiling of bleached pulp from the base bleach sequence employing the same bleaching chemicals, times and amounts of bleaching chemicals in the absence of the activation stage. The difference in brightness ceilings is usually at least about 1 brightness points as determined by the brightness test TAPPI T452. The difference in brightness ceilings is at least about 2 brightness points, more preferably from about 2 to about 6 brightness points and most preferably from about 3 to about 4 brightness points. The brightness ceiling of pulp bleached in accordance with this invention is at least about 84 as determined by the brightness test of TAPPI T452. The brightness ceiling is preferably at least about 88, more preferably from about 88 to about 92, and most preferably from 89 to about 92.

Activation times and amounts of ozone employed in the activation stage may vary widely but are less than those typically employed in a distinct ozone bleaching stage followed by washing. Activation times are usually less than about 30 minutes, preferably less than about 20 minutes, more preferably from about 1 to about 15 minutes and most preferably from about 1 to about 10 minutes. Amounts of ozone employed are usually less than about 0.7% based on 100% Oven Dry ("OD") pulp. The amounts of ozone are preferably less than about 0.5%, more preferably from about 0.5% to about 0.1% and most preferably from about 0.3% to about 0.1% on the aforementioned basis.

In addition to the ozone activation stage, the bleaching sequence of this invention comprises a first acidic bleaching stage, an oxidative extraction stage and a second acidic bleaching stage. A washed pulp from brown stock washing is bleached in the first acidic bleaching stage. The pulp used in the first acidic bleaching stage preferably has a Kappa number equal to or less than about 30, more preferably equal to or less than about 25, and most preferably from about 5 to about 20. Pulp having the desired preferred Kappa number can be obtained from any convenient source or by any convenient means known to those of ordinary skill in the art. For example, the pulp can be obtained through use of modified continuous cooking (MCC), extended modified continuous cooking (EMCC), rapid displacement heating (RDH), super batch, anthraquinone, polysulfide, enzymes, high heat washing, oxygen delignification and the like, and combinations thereof. In the preferred embodiments of the invention, suitable pulp is obtained by treating the pulp after brown stock washing and before the first acidic bleaching stage in an oxygen delignification stage and more preferably followed by at least one washing stage after oxygen delignification to provide pulp having the desired kappa number for use in the first acidic bleaching stage.

In the first acidic bleaching stages, the pulp is bleached employing conventional techniques. Active bleaching agents used in the first acidic bleaching stage may vary widely and any conventional bleaching agent operable under acidic conditions (pH less than 7, preferably equal to or less than about 6, more preferably equal to or less than about 5 and most preferably from about 1 to about 5) may be used. For example, useful agents include ozone, elemental chlorine chlorine dioxide, peracids such as peroxymono sulfuric acid and peroxyacetic acid, dimethyl dioxirane or mixtures thereof. The bleaching agent employed in the first acidic bleaching stage preferably comprises ozone, or a chlorine based bleaching agent such as chlorine dioxide or chlorine. In the more preferred embodiments of the invention, the bleaching agent employed in the first acidic bleaching stage is ozone or chlorine dioxide, in which the amount of active elemental chlorine bleaching agent is less than about 30%, preferably less than about 20%, more preferably less than about 10%, and most preferably less than about 5% active elemental chlorine. The bleaching agent employed in the second acidic bleaching stage is preferably chlorine dioxide in which the amount of elemental chlorine can vary as described above.

In the first alkaline bleaching stage, the pulp from the first acidic bleaching stage is subjected to alkaline bleaching employing conventional techniques. The bleaching agents employed in the first alkaline bleaching stage or any additional alkaline bleaching stages may vary widely and any conventional agent that is operable under alkaline conditions (pH at some point during said bleaching stage is greater than 7, preferably equal to or greater than about 8.2, more preferably equal to or greater than about 9 and most preferably from about 9 to about 12) can be used. Illustrative of useful agents are hydrogen peroxide, oxygen in the presence of base, sodium hypochlorite or a combination thereof. The alkaline bleaching stage is preferably an oxidative extraction with oxygen in the presence of base, preferably in the presence of hydrogen peroxide.

The types of bleaching sequences and the number and type of bleaching stages comprising the sequences may vary widely provided that the essential first and second acidic bleaching stages and alkaline bleaching stage are present. Additional bleaching stages may be aklaline or acidic. Illustrative of bleaching agents useful in this additional acidic bleaching stages are ozone, chlorine, chlorine dioxide, peracids such as peroxy sulfuric acid and peroxy acetic acid, dimethyl dioxirane and the like, and illustrative of bleaching agents useful in these additional alkaline bleaching stages are oxygen in the presence of base, peroxide sodium hypochlorite and the like. In the preferred embodiments of this invention described in this application the invention is described more particularly with respect to the D(EOP)D sequence wherein D represents bleaching with chlorine dioxide which contains no or substantially no elemental chlorine and (EOP) represents oxidative extraction in the presence of base preferably sodium hydroxide and an effective amount of peroxide. Other possible sequences include: (D/C)(EOP)(ZD), D(EOP)(ZD)D, D(EOP)(ZD)(DD), D(EOP)(ZD)ED, DEDE(ZD)D, ZE(ZD)D, Z(EOP)(ZD), DEZ(ZD), ZEP(ZD)P, DEZD(ZD), D(EOP)D(ZD) Z(EOP)D(ZD)P, Z(EOP)P(ZD)P, D(EOP)P(ZD)P, D(EOP)(DZ)(ZD), D(EOP)(ZD) and the like in which D is as described above and Z is ozone, E is extraction in the presence of base, O is oxygen, P is peroxide, D/C is a mixture of chlorine dioxide and elemental chlorine and two or more symbols in parenthesis indicate an absence of an intermediate washing stage.

The following examples are presented to describe the invention in greater detail but should not be construed as limitations thereto.

EXAMPLE I

A series of experiments were carried out to evaluate the effect of ozone activation on the bleaching process. the factor selected for evaluation was chlorine dioxide bleach consumption required to reach a certain brightness. The base bleach sequence was D(EOP)D and the embodiment of this invention evaluated was D(EOP)(ZD). The procedures employed were as follows:

A. Medium Consistency Ozone Activation Washed pulp after the (EOP) stage was mixed with sulfuric acid to pH3. The pulp was then charged to the high intensity mixer and heated to 130° F. The calculated quantity of ozone was injected while mixing at high speed (about 20 seconds). When ozone injection was complete, mixing speed was reduced and the pulp was held for 5 minutes. At the end of that time, pulp was removed from the mixing bowl after releasing the residual gases through acidified potassium iodide solution to trap any unreacted ozone. The final pH of the pulp was measured. The ozonated pulp without washing was subjected to varying levels of chlorine dioxide charges to get the desired brightness levels. Sodium hydroxide was used to maintain the desired pH in the chlorine dioxide stage. At the end of this stage, pulp pH and residual chlorine dioxide were measured. The pulp was washed and brightness and viscosity of the pulp were measured according to TAPPI standards T452 and T230, respectively.

B. High Consistency Ozone Activation

Washed pulp after the (EOP)/(EO) stage was mixed with sulfuric acid to pH3 and thickened to 35% consistency. The pulp was then fluffed and a known weight of pulp was contacted with the required amount of ozone in the lab ozonator for 3 minutes by passing an ozone/oxygen mixture into the ozonator. The gases leaving the ozonator was passed through acidified potassium iodide solution to trap unreacted ozone. At the end of the reaction time, the pulp without washing was treated with chlorine dioxide at medium consistency. Sodium hydroxide was used to maintain the desired pH in the chlorine dioxide stage. At the end of this stage, pulp pH and residual chlorine dioxide were measured. The pulp was washed and brightness and viscosity were measured according to TAPPI standards T452 and T230, respectively. The results are set forth in the following Tables 1 and 2.

TABLE 1

Effect Of High Consistency Ozone Activation On Chlorine Dioxide ($ClO_2$) Usage Starting Pulp After Oxygen Delignification: Kappa Number 14.1, Viscosity 15.6

| | Control D (EOP) D Sequence | With Ozone activation D (EOP) (ZD) Sequence |
|---|---|---|
| ($D_{100}$) Stage | | |
| $ClO_2$ added % | 1.29 | 0.54 |
| Kappa Factor | 0.24 | 0.1 |
| (EOP) Stage | | |
| NaOH, % | 1.4 | 1.2 |
| $H_2O_2$, % | 0.5 | 0.5 |
| Permanganate | 2.0 | 4.0 |

TABLE 1-continued

Effect Of High Consistency Ozone Activation On Chlorine Dioxide ($ClO_2$) Usage Starting Pulp After Oxygen Delignification: Kappa Number 14.1, Viscosity 15.6

| | Control D (EOP) D Sequence | With Ozone activation D (EOP) (ZD) Sequence |
|---|---|---|
| number | | |
| Brightness | 67.5 | 50.4 |
| Activation Stage | | |
| Time, min. | — | 3 |
| Ozone, % | — | 0.35 |
| Brightness | — | 74.3 |
| Final pH | — | 2.6 |
| Consistency, % | — | 38 |
| Final D Stage | | |
| Brightness target | 88 | 88 |
| $ClO_2$, % | 1.15 | 0.88 |
| NaOH, % | 0.5 | 0.7 |
| Viscosity, cp | 11.2 | 9.8 |

TABLE 2

Effect Of Medium Consistency Ozone Activation On Chlorine Dioxide ($ClO_2$) Usage Softwood Pulp after oxygen delignification: Kappa number 10.7, Viscosity 16.4 cp.

| | Control D (EOP) D Sequence | With Ozone Activiation D (EOP) (ZD) Sequence |
|---|---|---|
| ($D_{100}$) Stage | | |
| Kappa factor | 0.22 | 0.1 |
| $ClO_2$ added, % | 0.90 | 0.41 |
| (EOP) Stage | | |
| NaOH, % | 1.1 | 1.0 |
| $H_2O_2$, % | 0.35 | 0.5 |
| Permanganate number | 1.9 | 2.8 |
| Brightness | 68.7 | 64 |
| Activation Stage | | |
| Time, min. | — | 5 |
| Consistency | — | 11 |
| Ozone, % | — | 0.37 |
| Final pH | — | 2.6 |
| Brightness | — | 80.9 |
| Final D Stage | | |
| Brightness target | 88 | 88 |
| $ClO_2$, % | 1.0 | 0.8 |
| NaOH, % | 0.35 | 0.60 |
| FINAL pH | 3.4 | 3.2 |

The results set forth in Tables 1 and 2 show that substantially less $ClO_2$ is required to reach a target brightness when high and medium consistency ozone activation are employed.

EXAMPLE II

Employing the procedure of EXAMPLE I a series of experiments were carried out to evaluate the effect of ozone activation upon the brightness ceiling. The results are set forth in the following Tables 3 and 4.

TABLE 3

Bleaching To Higher Brightness Using The OD (EO) (ZD) Bleaching Sequence With High Consistency Ozone Activation Stage As Compared To D (EOP) D Control Bleaching Sequence Softwood Pulp after Oxygen Delignification: Kappa number 14.1, Viscosity 15.6 cp.

| | Control D (EOP) D Sequence | | | With Ozone Activation D (EO) (ZD) Sequence | |
|---|---|---|---|---|---|
| ($D_{100}$) Stage | | | | | |
| Kappa factor | 0.24 | | | 0.22 | |
| $ClO_2$ added, % | 1.29 | | | 1.18 | |
| (EOP) Stage | | | | | |
| NaOH, % | 1.4 | | | 1.4 | |
| $H_2O_2$, % | 0.5 | | | — | |
| Permanganate number | 1.9 | | | 3.0 | |
| Brightness | 67.5 | | | 48.1 | |
| Final pH | 11.3 | | | — | |
| Activation stage | | | | | |
| Time, min. | — | | | 3 | |
| Ozone, % | — | | | 0.35 | |
| Brightness | — | | | 78.3 | |
| Final pH | — | | | 2.7 | |
| Consistency, % | — | | | 38 | |
| Final D Stage | | | | | |
| $ClO_2$, % | 0.7 | 1.1 | 1.5 | 0.75 | 1.0 |
| NaOH, % | 0.25 | 0.45 | 0.65 | 0.6 | 0.7 |
| Brightness | 86.0 | 87.8 | 88.8 | 89.6 | 90.7 |
| Viscosity, cp | 12.6 | — | 10.8 | 10.5 | 10.1 |

TABLE 4

Bleaching To Higher Brightness Using The OD (EOP) (ZD) Sequence With Medium Consistency Ozone Activation As Compared To D (EOP) (DD) Control Bleaching Sequence Softwood Pulp after Oxygen Delignification: Kappa number 14.1, Viscosity 15.6 cp.

| | Control D (EOP) (DD) Sequence | With Ozone Activation D (EOP) (ZD) Sequence |
|---|---|---|
| ($D_{100}$) Stage | | |
| Kappa factor | 0.22 | 0.22 |
| $ClO_2$ added, % | 0.90 | 1.18 |
| (EOP) Stage | | |
| NaOH, % | 1.1 | 1.0 |
| $H_2O_2$, % | 0.5 | 0.5 |
| Permanganate number | 1.9 | 3.0 |
| Brightness | 68.7 | 64.1 |
| Activation stage | | |
| Time, min. | 60 | 5 |
| $ClO_2$/Ozone, % | 0.5 | 0.53 |
| Brightness | 84.7 | 83.7 |
| Final pH | 3.6 | 2.2 |
| Consistency, % | 10 | 12 |
| Final D Stage | | |
| $ClO_2$, % | 0.60 | 0.60 |
| NaOH, % | 0.25 | 0.82 |
| Brightness | 89.6 | 91.5 |
| Viscosity, cp | 12.8 | 11.7 |
| Final pH | — | 3.0 |

The data set forth in Table 3 clearly show that ozone activation elevates the brightness ceiling of the base D(EOP)D bleaching sequence substantially even in the absence of peroxide in the oxidative extraction stage, and the data in Table 4 clearly show that ozone activation is much more effective in elevating the brightness ceiling of the base D(EOP)D bleaching sequence than chlorine dioxide in much shorter activation times e.g., 5 mins vs. 60 mins.

EXAMPLE III

The effect of ozone activation upon total chloride levels was evaluated. Chloride levels were calculated based upon the results of Examples I and II. The results are set forth in the following Table 4.

TABLE 5

Effect Of Ozone Activation Upon Chloride Concentration levels in Bleach Plant Filtrate

| | Baseline D (EOP) D Sequence | | Ozone Activation D (EOP) (ZD) Sequence | |
|---|---|---|---|---|
| | A | B | C | D |
| Starting Kappa Number of Pulp After Oxygen Delignification . . . | 14.1 | 10.7 | 14.1 | 10.7 |
| Total $ClO_2$ Usage, % on Oven Dry Pulp, . . . | 2.44 | 1.9 | 1.42 | 1.21 |
| Sodium Chloride in Filtrates Calculated, lbs/ton of Pulp . . . | 42.3 | 33.1 | 24.7 | 21.1 |
| Reduction in Sodium Chloride Level, % . . . | — | — | 41.6 | 36.3 |

EXAMPLE IV

Employing the procedure of Example I, a series of experiments were carried out to compare the effect of activation with ozone to activation with chlorine dioxide, chlorine, sodium sulfite and peroxymono sulfuric acid ("Caro's Acid"). The results are set forth in the following Table 6 in which bleaching sequences of D(EOP)(ZD), D(EOP)(YD), D(EOP)((CA)D), D(EOP)(DD) and D(EOP)(CD) in which "D" is chlorine dioxide, "Z" is ozone, "C" is elemental chlorine, "Y" is sodium sulfite and "CA" is Caro's Acid derived from "Oxone" were used in experiment nos. 1, 2, 3, 4 and 5, respectively.

TABLE 6

Effect of Ozone Activation on Improving Brightness Ceiling Comparison of D (EOP) (DD), D (EOP) (CD), D (EOP) ((CA) D), D (EOP) (YD) and D (EOP) ZD) Sequences
Starting pulp: Softwood Pulp After Oxygen Delignification

| Exp. No. | 1 | 2 | 3 | 4 | 5 |
|---|---|---|---|---|---|
| Starting Kappa No. | 14.1 | 14.1 | 15.1 | 12.3 | 14.1 |
| First Stage ($D_{100}$) | | | | | |
| Kappa factor | 0.10 | 0.10 | 0.10 | 0.10 | 0.10 |
| $ClO_2$ added, % | 0.54 | 0.54 | 0.60 | 0.47 | 0.54 |
| Second Stage (EOP) | | | | | |
| NaOH, % | 1.2 | 1.2 | 1.1 | 1.0 | 1.0 |
| $H_2O_2$, % | 0.5 | 0.5 | 0.5 | 0.5 | 0.5 |
| Permanganate number | 4.0 | 4.0 | 5.2 | 4.3 | 4.0 |
| Brightness | 50.4 | 51.1 | 52.3 | 52.4 | 51.1 |
| Third Stage, Activation | | | | | |
| Time, min. | 3 | 60 | 30 | 60 | 30 |
| Consistency, % | 38 | 11 | — | 10 | 11 |
| Permanganate number | 1.8 | 4.0 | 3.7 | — | 3.1 |
| Brightness | 74.3 | 56.5 | 62.2 | 78.8 | 53.5 |
| Final pH | 2.6 | 5.3 | 6.8 | 3.1 | 2.3 |
| Chemical, % | 0.35 (Z) | 0.5 (Y) | 0.5 (CA) | 0.6 (D) | 0.5 (C) |
| Final D Stage | | | | | |
| $ClO_2$, % | 1.0 | 1.0 | 1.0 | 1.0 | 1.0 |
| NaOH, % | 0.8 | 0.55 | 0.4 | 0.3 | 0.9 |
| Final pH | 3.4 | 3.4 | 3.6 | 2.5 | 3.8 |
| Brightness | 88.8 | 82.8 | 81.1 | 82.1 | 83.2 |

The data set forth in Table 6 clearly shows that ozone is much more effective as an activation agent than chlorine dioxide, elemental chlorine, sodium sulfite and Caro's Acid, even when ozone is used in much smaller amounts. For example, ozone when used in an amount of 0.35% provided pulp having a brightness ceiling of 88.8, while chlorine dioxide, elemental chlorine, sodium sulfite and Caro's Acid when used in amounts of 0.6%, 0.5%, 0.5% and 0.5%, respectively, provided pulp having a brightness ceiling of only 82.1, 83.2, 82.8 and 81.1, respectively.

EXAMPLE V

Referring to FIG. 1 of the drawings, wood chips or other comminuted cellulosic fibrous material is fed via line 2 to a continuous digester 4 where the materials are subjected to pulping action of a pulping liquor generated in causticizer 6 and conveyed to digester 4 via line 8. A variety of pulping procedures may be used such as the Kraft, soda, soda-oxygen, $H_2S$-pretreatment Kraft, alkaline, polysulfide and alkaline sulfite processes. In FIG. 1, the process will be described with particular reference to the preferred Kraft process in which the active pulping chemicals are contained in a white liquor comprising sodium hydroxide and sodium sulfide. The resulting pulp, usually having a Kappa number of greater than about 30, is fed via line 10 to brown stock washing stage 11 for at least one stage of washing, preferably from two to about four stages of washing and more preferably about three stages of washing to remove all or a portion of entrained pulping liquor. After brown stock washing the washed pulp is charged via line 12 to oxygen delignification stage 14. In the oxygen delignification stage 14, the pulp is treated with oxygen, preferably in the presence of base such as sodium hydroxide, and at elevated temperature and at elevated pressure to reduce the Kappa number of the pulp to less than 30, preferably less than about 25, more preferably from about 5 to about 20 and most preferably from about 14 to about 20 for hardwood pulp and from about 8 to about 18 for softwood pulp. While oxygen delignification is used in the preferred embodiments of this invention depicted in the drawing to reduce the Kappa Number of the pulp to the desired value other conventional procedures can be used. The oxygen delignified pulp is then subjected to at least one stage of post oxygen delignification washing, preferably from 2 to about 4 stages, where the oxygen delignified pulp is washed. While the washer employed in the preferred embodiments of the invention is a press washer, the type of washer used may vary widely and other conventional washers, as for example a CB washer, drum washer, belt washer, press washer, diffusion washer, two stage washer, and the like may be used.

In FIG. 1, the pulp is conveyed to two post oxygen delignification washers 16 and 18 via lines 20 and 22, respectively, to further remove lignin and inorganic materials. After the last post oxygen washing stage 18, the pulp preferably has a consistency of from about 2% to about 14%. The pulp can be stored in a storage tank (not depicted) until required for the first acidic bleaching stage 24 or conveyed directly to stage 24 via line 26 as depicted in the figure. In first acidic bleaching stage 24, the pulp is bleached under acidic conditions with a bleaching agent comprising ozone or chlorine dioxide. In the preferred embodiments of the invention as depicted in the figure, the bleaching agent is chlorine dioxide comprising less than about 30%, preferably less than about 20%, more preferably less than about 10% and most preferably less than about 5% of the active bleaching agent is elemental chlorine. In the embodiments of the invention of choice, the active bleaching agent is chlorine dioxide which contains no or substantially no elemental chlorine (i.e. less than about 1% to about 5%). The application rates, pHs, times and temperatures used in the acidic bleaching stage may vary widely and any known to the art can be used. The bleached pulp is conveyed via line 28 to at least one post first acidic bleaching stage washer or decker 29. After washing on washer 29, the pulp, preferably where the amount of non-process metals is such that the extraction stage is not adversely affected to an undue extent, is conveyed via line 30 to extraction stage 32 where the pulp is extracted under alkaline conditions. While any suitable extraction stage agents and conditions can be used, in the preferred embodiments of the invention, alkaline bleaching stage 166 is oxidative extraction with oxygen in the presence of base preferably carried out in the presence of peroxide, employing conventional oxidative extraction times, pressures and temperatures. After extraction stage 32, the extracted pulp is conveyed from extraction stage 32 via line 34 to post extraction stage washer 36 where the extracted pulp is washed.

In the embodiment of FIG. 1, the washed extracted pulp is conveyed from washer 36 via line 38 where the pH of the pulp is adjusted to a pH of less than 7 (preferably less than about 5 and more preferably from about 2 to about 3) by the addition of acid as for example sulfuric acid via line 40. The acidified pulp is then conveyed via line 38 to ozone activation unit 42 under force of pump 44 for activation by the addition of an effective amount of ozone to the pulp. As depicted in FIG. 1, ozone activation unit 42 consists of an ozone generator 46, a compressor 48, mixer 50, and holding tube 52. A gaseous mixture comprising oxygen and ozone, preferably from about 4% to about 14% ozone, more preferably from about 6% to about 12% ozone, and most preferably from about 10% to about 12% ozone, is generated in an ozone generator 46 at ambient pressure. The ozone is conveyed to a compressor 48 via line 54 where the gaseous mixture is preferably pressurized to the required extent, preferably to a pressure of about 10 bar to about 12 bar after which the ozone mixture is conveyed via line 56 to mixer 50 for mixing with the pulp. After mixing, the mixture of pulp and ozone is conveyed to holding tube 58 via line 60 where the mixture is held for a time and at a temperature sufficient for the desired activation to occur, preferably with complete consumption of the ozone. The residence temperature is preferably from about 20° to about 70° C., and more preferably from about 40° to about 55° C. Residence times are preferably at least about 30 minutes, more preferably from about 1 to about 15 minutes and most preferably from about 1 to about 5 minutes.

After ozone activation, the activated pulp is conveyed via line 62 without an intermediate washing stage or with venting of the activation gas via line 64 preferably with destruction of residual ozone in the activation gas, if any, to second acidic bleaching stage 66 where the pulp is bleached substantially as described above for first acidic bleaching stage 24. The pulp can be processed from system and used for conventional purposes or the pulp can be subjected to one or more additional acidic and/or alkaline bleaching stages as for example further bleaching with one or more bleaching agents selected from the group consisting of peroxide, chlorine dioxide and ozone. Such additional bleaching stages may be without subsequent washing or may be followed by subsequent wash stage or stage(s). As depicted in FIG. 1, pulp can be conveyed from stage 66 via line 68 to at least one post acidic bleaching washing stage 70 where the pulp is washed. The washed pulp exits the bleaching sequence via line 72 for conventional use as for example in a paper making process.

Many variations of the present invention will suggest themselves to those of ordinary skill in the art in light of the above-detailed description. All such obvious modifications are within the full intended scope of the appended claims.

What is claimed is:

1. A process for manufacturing bleached wood pulp of the type comprising subjecting wood pulp after at least one brown stock washing stage to a base bleach process comprising the steps of:

bleaching said pulp in a first acidic bleaching stage to form a first acidic bleached pulp;

bleaching said first acidic bleached pulp in a first alkaline bleaching stage to form a first alkaline bleached pulp;

bleaching said first alkaline bleached pulp in a second acidic bleaching stage to form a second acidic bleached pulp comprising mixing said first alkaline bleached pulp after acidification with a gaseous mixture comprising an effective amount of ozone to form a mixture and maintaining said mixture for a residence time and at a residence temperature sufficient to allow consumption of all or a portion of said ozone by one or more chemically reactive components of said pulp to form said second acidic bleached pulp; and bleaching said second acidic bleached pulp in a third acidic bleaching stage with an active bleaching agent comprising chlorine dioxide or a mixture of chlorine dioxide and elemental chlorine in the absence of an intermediate washing stage to provide third acidic bleached pulp having a brightness ceiling which is higher than the brightness ceiling of a third acidic bleached pulp bleached in a bleach sequence identical to that used to form the third acidic bleached pulp and having the same number of bleaching stages except that ozone is not used as the active bleaching agent in the second acidic bleaching stage.

2. Process of claim 1 wherein said difference between the brightness of said second bleached activated pulp and said brightness ceiling of said second bleached pulp is at least 1 ISO brightness point as determined by TAPPI method T452.

3. Process of claim 2 wherein said difference is at least about 2 brightness points.

4. Process of claim 3 wherein said difference is from about 2 to about 6 brightness points.

5. Process of claim 1 wherein said second bleached activated pulp has a brightness ceiling of at least about 84 as determined by TAPPI T425.

6. Process of claim 5 wherein said second bleached activated pulp has a brightness ceiling of at least about 88.

7. Process of claim 6 whereas said second bleached activated pulp has a brightness ceiling of from about 88 to about 92.

8. Process of claim 1 wherein said residence time is less than about 30 minutes.

9. Process of claim 8 wherein said residence time is at least about 20 minutes.

10. Process of claim 9 wherein said residence time is from about 1 to about 15 minutes.

11. Process of claim 10 wherein said residence time is from about 1 to about 5 minutes.

12. Process of claim 1 wherein the amount of said ozone is less than about 0.7% based on 100% Oven Dry pulp.

13. Process of claim 12 wherein said amount of ozone is less than about 0.5%.

14. Process of claim 13 wherein said amount of ozone is from about 0.5% to about 0.1%.

15. Process of claim 13 wherein said amount of ozone is from about 0.3% to about 0.1%.

16. Process of claim 1 wherein said residence temperature is equal to or less than about 70° C.

17. Process of claim 16 wherein said temperature is from about 20° to about 70° C.

18. Process of claim 17 wherein said temperature is from about 40° to about 55° C.

19. Process of claim 1 wherein said first acidic bleaching stage bleaching agent and said second acidic stage bleaching agent is chlorine dioxide comprising less than about 10% elemental chlorine.

20. Process of claim 1 wherein said first acidic bleaching stage bleaching agent is ozone or chlorine dioxide, said second acidic stage bleaching agent is chlorine dioxide and comprising less than about 10% elemental chlorine.

21. Process of claim 20 wherein said first acidic stage bleaching agent is ozone.

22. Process of claim 1 wherein said alkaline bleaching stage is oxidative extraction.

23. Process of claim 22 wherein said oxidative extraction is in the presence of hydrogen peroxide.

24. A process for manufacturing bleached wood pulp of the type comprising subjecting wood pulp after at least one brown stock washing stage to a base bleach process comprising the steps of:

bleaching said pulp in a first acidic bleaching stage with a bleaching agent comprising ozone to form a first acidic bleached pulp;

extracting said first acidic bleached pulp in an oxidative extraction stage to form a first extracted pulp;

bleaching said first extracted pulp in a second acidic bleaching stage to form a second acidic bleached pulp comprising mixing said first extracted pulp after acidification with a gaseous mixture comprising an effective amount of ozone to form a mixture and maintaining said mixture for a residence time and at a residence temperature sufficient to allow consumption of all or a portion of said ozone by one or more chemically reactive components of said pulp to form said second acidic bleached pulp; and bleaching said second acidic bleached pulp in a third acidic bleaching stage with an active bleaching agent comprising chlorine dioxide or a mixture of chlorine dioxide and elemental chlorine in the absence of an intermediate washing stage to provide a third acidic bleached pulp having a brightness ceiling which is higher than the brightness ceiling of a third acidic bleached pulp bleached in a bleach sequence identical to that used to form the third acidic bleached pulp and having the same number of bleaching stages except that ozone is not used as the active bleaching agent in the second acidic bleaching stage.

25. A process for manufacturing bleached wood pulp of the type comprising subjecting wood pulp after at least one brown stock washing stage to a base bleach process comprising the steps of:

bleaching said pulp in a first acidic bleaching stage with a bleaching agent comprising chlorine dioxide or a mixture of chlorine dioxide and elemental chlorine to form a first acidic bleached pulp;

extracting said first acidic bleached pulp in an oxidative extraction stage to form a first extracted pulp;

bleaching said first extracted pulp in a second acidic bleaching stage to form a second acidic bleached pulp comprising mixing said first extracted pulp after acidification with a gaseous mixture comprising an effective amount of ozone to form a mixture and maintaining said mixture for a residence time and at a residence temperature sufficient to allow consumption of all or a portion of said ozone by one or more chemically reactive components of said pulp to form said second acidic bleached pulp; and bleaching said second acidic bleached pulp in a third acidic bleaching stage with an active bleaching agent comprising chlorine dioxide or a mixture of chlorine dioxide and elemental chlorine in the absence of an intermediate washing stage to provide a third acidic bleached pulp having a brightness ceiling which is higher than the brightness ceiling of a third acidic bleached pulp bleached in a bleach sequence identical to that used to form the third acidic bleached pulp and having the same number of bleaching stages except that ozone is not used as the active bleaching agent in the second acidic bleaching stage.

* * * * *